US012590786B2

(12) United States Patent
Johnson

(10) Patent No.: US 12,590,786 B2
(45) Date of Patent: Mar. 31, 2026

(54) TOY FOAM DART WITH IMPACT ABSORBING TIP

(71) Applicant: Buzz Bee Toys, Inc., Mt. Laurel, NJ (US)

(72) Inventor: Brownie Johnson, Mt. Laurel, NJ (US)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 246 days.

(21) Appl. No.: 18/503,573

(22) Filed: Nov. 7, 2023

(65) Prior Publication Data

US 2024/0167798 A1 May 23, 2024

Related U.S. Application Data

(60) Provisional application No. 63/426,531, filed on Nov. 18, 2022.

(51) Int. Cl.
*A63B 65/02* (2006.01)
*F42B 6/00* (2006.01)
*F42B 6/08* (2006.01)

(52) U.S. Cl.
CPC ..... *F42B 6/003* (2013.01); *F42B 6/08* (2013.01)

(58) Field of Classification Search
CPC ..... F42B 6/003; F42B 6/08
See application file for complete search history.

(56) References Cited

U.S. PATENT DOCUMENTS

| | | | | |
|---|---|---|---|---|
| 4,593,913 | A * | 6/1986 | Kochevar | A63B 53/08 473/585 |
| 4,887,822 | A * | 12/1989 | Tsai | F42B 12/362 473/585 |
| 8,012,049 | B1 * | 9/2011 | Walterscheid | F42B 6/003 473/578 |
| 8,968,126 | B2 * | 3/2015 | Chia | F42B 6/08 473/578 |
| 10,018,451 | B1 * | 7/2018 | Ma | F42B 6/003 |
| 10,030,950 | B1 | 7/2018 | Chia et al. | |
| 10,408,583 | B2 * | 9/2019 | Isenmann | F42B 6/003 |
| 2006/0046877 | A1 * | 3/2006 | Gajda, Jr. | F42B 6/10 473/578 |
| 2024/0142205 | A1 * | 5/2024 | Chia | F42B 6/00 |

* cited by examiner

*Primary Examiner* — John A Ricci
(74) *Attorney, Agent, or Firm* — Volpe Koenig

(57) ABSTRACT

A toy form dart having an elongate dart body and a dart tip connected thereto. The dart tip has an outer surface extending from a top to a bottom thereof, and a hollow passage extends through the dart tip in a first direction defining first and second mouth openings on opposing. First and second pairs of eye socket indents are located between the respective first and second mouth openings and the top of the dart tip, with the first and second eye socket indents penetrating partially into the dart tip and an interior boundary wall formed between each one of the first pair of eye socket indents and each respective oppositely located one of the second pair of eye socket indents. The first and second pairs of eye socket indents and the respective first and second mouth openings form a face configuration on the opposing sides of the dart tip.

16 Claims, 3 Drawing Sheets

TOY FOAM DART WITH IMPACT ABSORBING TIP

CROSS-REFERENCE TO RELATED APPLICATIONS

This application claims the benefit of U.S. Provisional Application No. 63/426,531, filed Nov. 18, 2022, which is incorporated herein by reference as if fully set forth.

FIELD OF INVENTION

The disclosure relates to a toy foam dart for use with a toy projectile launcher.

BACKGROUND

Toy foam darts, such as a dart having a foam body and a tip attached to one end of the dart body, are known and may be launched with a compatible toy dart launcher toward a person or an object. The tips of the toys darts are generally made of a rubber or other polymeric material having a higher weight than the foam that allows the dart to be launched from the launcher with greater speed and accuracy, but without injuring, or at least limiting the injury or discomfort felt by, the targeted person or object.

As consumers seek toy foam darts with greater accuracy and distance capabilities, this also raises a safety issue in order to avoid potential injury to users that are impacted by the toy foam projectiles since this is typically done by adding more weight to the tip. In the United States, ASTM F 963-16, The Standard Consumer Safety Specification for Toy Safety, is required to be met by all toy foam projectiles. This Standard specifies the requirements for a Kinetic Energy Density (KED) test with a maximum of 2500 J/m2 (Joules/meter square) for projectile toys. Accordingly, improved performance toy foam darts are usually at odds with the KED requirements.

It would be desirable to provide an improved foam dart toy which can provide improved distance and/or accuracy while at the same time meeting the KED requirements to avoid and/or limit damage from the impact of such toy foam darts, while also providing enhanced play features.

SUMMARY

In one aspect, the present disclosure is directed to a toy form dart having an elongate dart body with an interior bore that extends in a longitudinal direction from a head end to a tail end of the elongate dart body, and a dart tip connected to the head end of the elongate dart body. The dart tip has a top, a bottom that is affixed into the interior bore at the head end of the elongate dart body, and an outer surface extending from the top to the bottom of the dart tip in the longitudinal direction is bounded by a cylindrical envelope. A hollow passage extends through the dart tip in a first direction perpendicular to the longitudinal direction defining first and second mouth openings on opposing sides of the dart tip. The hollow passage has an aspect ratio of at least 1:1 of a passage width in a second direction that is perpendicular to the first direction and the longitudinal direction in comparison to a passage height in the longitudinal direction. In some embodiments, the aspect ratio is 2:1, or can be 3:1 or greater. Edges of the hollow passage define the width in the first direction. These edges may be curved. First and second pairs of eye socket indents are located between the respective first and second mouth openings and the top of the dart tip, with the first and second eye socket indents penetrating only partially into the dart tip and an interior boundary wall formed between each one of the first pair of eye socket indents and each respective oppositely located one of the second pair of eye socket indents. The first and second pairs of eye socket indents and the respective first and second mouth openings form a face configuration on the opposing sides of the dart tip.

The toy darts having this configuration meet KED standards due to the hollow passageway and the eye socket indents providing an area for the dart tip, and specifically the top, to deform upon impact of the tart tip with an object, absorbing impact energy in order to greatly reduce the likelihood of injury or damage. Further, the face configuration provides additional play interest as well as the ability for a user to more easily sort toy darts from different users.

Additionally, the hollow passageway combined with the partial removals of material in the eye socket indents allow the overall weight as well as the weight distribution at the dart tip to be more accurately controlled, which provides for improved accuracy.

In one embodiment, the hollow passage has a greater opening dimension for the passage height at the edges in comparison to an opening dimension for the passage height at a medial portion. In one preferred arrangement, the opening dimension for the passage height at the edges is at least two times the opening dimension for the passage height at the medial portion.

In another embodiment, the hollow passage has a smaller opening dimension for the passage height at the edges in comparison to an opening dimension for the passage height at a medial portion.

In one embodiment, the hollow passage has a planar upper surface closer to the top of the dart tip.

In one embodiment, the hollow passage has a smaller opening dimension for the passage height at the edges in comparison to an opening dimension at a medial portion, and the edges are located closer to the top of the dart tip than a medial portion of the hollow passage.

In one arrangement, the edges are located in a plane perpendicular to the longitudinal direction that intersects a lower portion of the first and second pairs of eye socket indents. This provides improved flexibility for energy absorption.

In one embodiment, the hollow passage has a generally uniform opening dimension for the passage height, and the edges are located closer to the top of the dart tip than a medial portion of the hollow passage such that the hollow passage has a curved profile at the first and second mouth openings. This arrangement provides for a distinctive "smiley face" for the face configuration.

In some embodiments, the eye socket indents of each of the first and second pairs of eye socket indents have a circular configuration. Alternatively, the eye socket indents of each of the first and second pairs of eye socket indents have a non-circular configuration, with the eye socket indents in the first pair of eye socket indents being mirror-symmetric to one another about a longitudinal plane defined by the longitudinal direction and the first direction, and the eye socket indents in the second pair of eye socket indents being mirror-symmetric to one another about the longitudinal plane. Here the shapes can vary to provide different expressions for the face configuration.

Preferably, the dart tip is molded from a polymeric material which can be mixed with a weighting agent. In a particularly preferred embodiment, the weighting agent is calcium carbonate powder. In a particularly preferred embodiment, the calcium carbonate powder is between 10 and 20 wt % of the dart tip.

Preferably the dart tip has a weight of about 0.61 to 0.88 grams for a diameter of about inches (12.5-12.7 mm).

The top of the dart tip can be domed, flat or include a suction cup, or may have other configurations.

In another aspect, a toy comprising first and second sets of toy foam darts, preferably for use with first and second toy foam dart launchers, are provided with the first and second sets of toy foam darts each including a plurality of the foam darts as described above and in detail below. At least one of the first and second mouth openings or the first and second pairs of eye socket indents in the first set of toy foam darts are different than the first and second mouth openings or the first and second pairs of eye socket indents in the second set of toy foam darts. This provides "opposing" sets of toy foam darts for enhanced play by two or more users, with the first and second sets of toy foam darts having a different face configuration.

In another aspect, a toy form dart is provided that has an elongate dart body having an interior bore that extends in a longitudinal direction from a head end to a tail end of the elongate dart body and a dart tip connected to the head end of the elongate dart body. The dart tip has a top, a bottom that is affixed into the interior bore at the head end of the elongate dart body, and an outer surface extending from the top to the bottom of the dart tip in the longitudinal direction. The tip is formed of a polymeric material mixed with powdered weighting agent in order to achieve a desired weight for the dart tip. The amount of the weighting agent can be adjusted to achieve the desired weight in order to compensate for various configurations of the dart tip.

In one embodiment, the powdered weighting agent is between 10 and 20 wt % of the dart tip. The powered weighting agent can be calcium carbonate or any other suitable material.

In another embodiment, the dart tip weights 0.61 to 0.88 grams.

It is noted that various ones of the above-noted features can be used alone or in combination with one another to arrive at different toy foam dart configurations.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION

Figure 1:
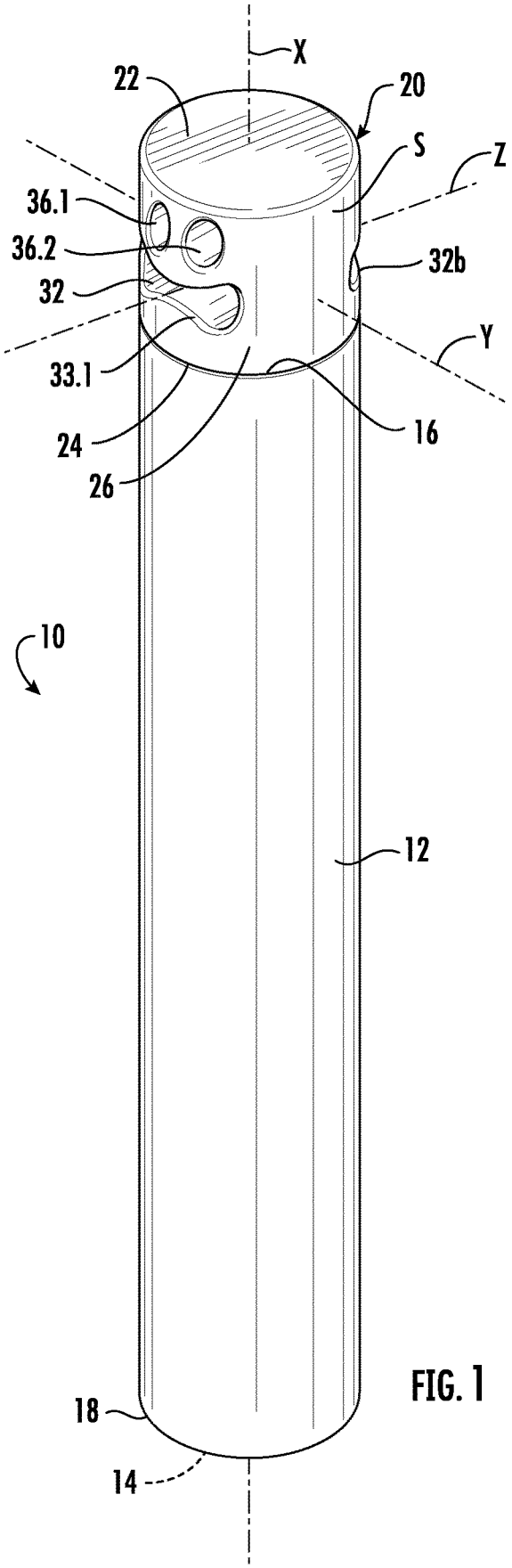
FIG. 1 is a top, front, right perspective view of a toy dart in accordance with a first embodiment of the disclosure.
Figure 2:
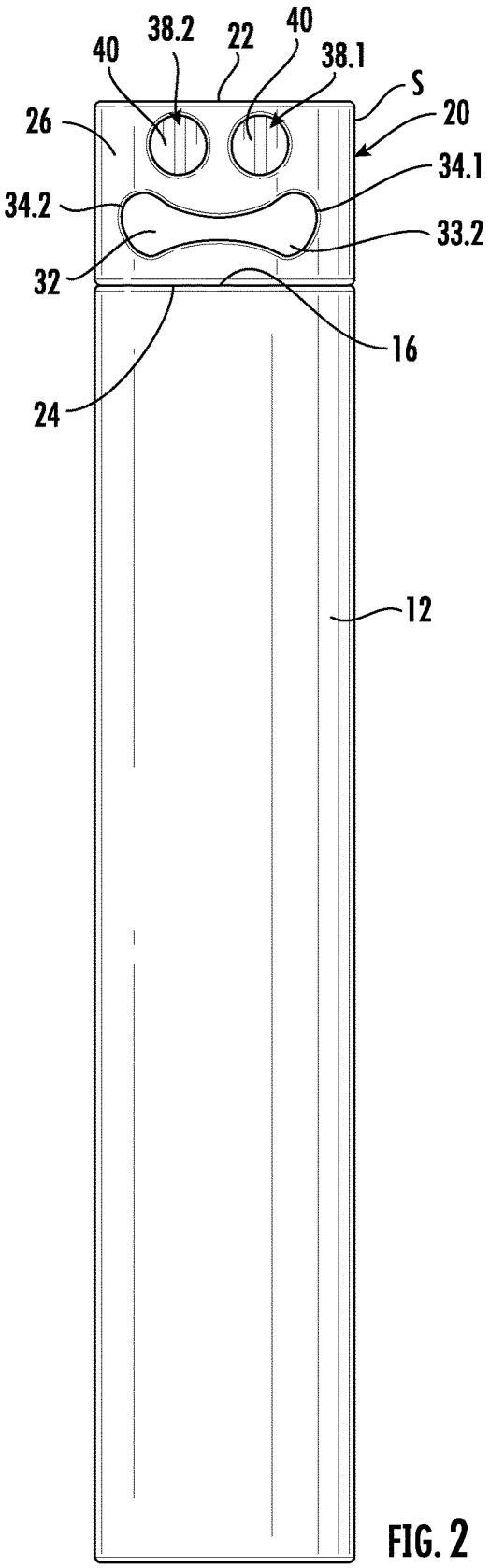
FIG. 2 is a rear elevational view of the first embodiment of the toy dart shown in FIG. 1.

Certain terminology is used in the following description for convenience only and is not limiting. The words "inwardly" and "outwardly" refer to directions toward and away from the parts referenced in the drawings. A reference to a list of items that are cited as, for example, "at least one of a or b" (where a and b represent the items being listed) means any single one of the items a or b, or a combination of a and b thereof. This would also apply to lists of three or more items in like manner so that individual ones of the items or combinations thereof are included. The terms "about" and "approximately" encompass + or −10% of an indicated value unless otherwise noted. The term "generally" in connection with a radial direction encompasses +/−25 degrees. The terminology includes the words specifically noted above, derivatives thereof and words of similar import.

Referring to FIGS. 1-3 and 12, a first embodiment of a toy foam dart 10 in accordance with the present disclosure is shown in detail. The toy foam dart 10 includes an elongate dart body 12, preferably made of foam, which has an interior bore 14 that extends in a longitudinal direction X from a head end 16 to a tail end 18 of the elongate dart body 12. The elongate dart body 20 preferably has a cylindrical outer shape as well as a cylindrical interior bore 14. However, the outer shape may vary. Additionally, the inner bore shape can also vary. In one embodiment, the elongate dart body 12 has a diameter of about 12 to 13 mm, and more preferably about 12.5 to 12.7 mm. However, this could vary depending on the particular application. Additionally, the length of the elongate dart body 12 in the longitudinal direction X in one embodiment is between 50 and 80 mm, and more preferably approximately 65-68 mm.

Still with reference to FIGS. 1-4, a dart tip 20 is connected to the head end 16 of the elongate dart body 12. The dart tip 20 has a top 22, a bottom 24 that is affixed to the elongate dart body 12, as well as an outer surface 26 that extends from the top 22 to the bottom 24 of the dart tip 20 in the longitudinal direction X that is preferably bounded by a cylindrical envelope S. Preferably, the bottom 24 is affixed to the interior bore 14 at the head end 16 of the elongate dart body 12. More preferably, a shank 28 (shown in FIG. 12) is connected to the bottom 24 of the dart tip 20 for insertion into the interior bore 14 to form a firm connection with the elongate dart body 12. Additionally, grooves 30 are preferably provided on the shank 28 to enhance the connection as well as provide room for adhesive and/or expansion of an interior of the elongate dart body 12 into the grooves to form a press fit.

Figure 3:
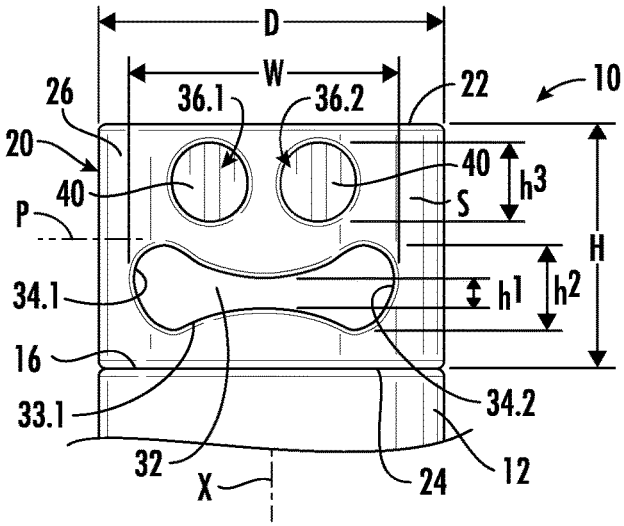
FIG. 3 is an enlarged front elevational view showing the dart tip and part of the elongate dart body of the toy foam dart shown in FIG. 1, it being understood that the rear elevational view is identical to the front elevational view.

As shown in FIG. 3, the dart tip 20 has a diameter D and a height H. In one preferred embodiment, the diameter D is the same as the diameter of the elongate dart body 12, and the height H of the elongate dart body in one embodiment is preferably between 6 and 7 mm. However, these dimensions could vary depending upon the particular application.

A hollow passage 32 extends through the dart tip 20 in a first direction Y perpendicular to the longitudinal direction X, defining first and second mouth openings 33.1, 33.2 on opposing side of the dart tip 20. The hollow passage 32 preferably has an aspect ratio of at least 1:1 of a passage width W in a second direction Z that is perpendicular to the first direction Y and the longitudinal direction X, in comparison to a passage height h2 in the longitudinal direction X. In most embodiments, the aspect ratio is at least 2:1, and more preferably 3:1 or greater. The edges 34.1, 34.2 of the hollow passage 32 define the width W in the first direction Y. These edges are preferably curved; however, they could be other shapes. However, this curvature as well as the shape of the hollow passage can vary as explained in detail below.

Still with reference to FIGS. 1-3 and 12, first and second pairs of eye socket indents 36.1, 36.2; 38.1, 38.2 are located between the respective first and second mouth openings 33.1, 33.2 and the top 22 of the dart tip 20. The first and second eye socket indents 36.1, 36.2; 38.1, 38.2 penetrate only partially into the dart tip 20 and an interior boundary wall 40 is formed between each one of the first pair of eye socket indents 36.1, 36.2 and each respective oppositely located one of the second pair of eye socket indents 38.1, 38.2.

The first and second pairs of eye socket indents 36.1, 36.2; 38.1, 38.2 and the respective first and second mouth openings 33.1, 33.2 form a face configuration on opposing sides of the dart tip 20. This face configuration on the opposing sides of the dart tip 20 is preferably the same, at least with respect to the first and second mouth openings 33.1, 33.2.

The hollow passage 32 that extends through the dart tip 20 allows flexibility of the surface that reduces surface impact and permits passing of the KED test for safety. In the present case, the dart tip 20 is molded from a polymeric material, preferably thermoplastic rubber. However, other materials could be used. Additionally, preferably a powdered weighting mixture is added to the polymeric material prior to molding. In one preferred embodiment, the powered weighting material is calcium carbonate powder and is preferably between 10 and 20 wt % of the dart tip 20. Those skilled in the art will recognize that other weighting materials can be used. In one preferred arrangement, the dart tip 20 weighs between 0.61 and 0.88 grams. However, the weight could vary depending upon the particular application. Additionally, the amount of weighting material can increase or decrease depending on the volume of the hollow passage 32 and the pairs of eye socket indents 36.1, 36.2; 38.1, 38.2 in order to achieve the desired weight. Additionally, the dart tip 20 preferably has a durometer that is between 20 and 80. More preferably, the durometer is between 30 and 40.

The hollow passage 32 together with the eye socket indents 36.1, 36.2; 38.1, 38.2 allow the weight of the dart tip 20 to be accurately controlled in order to meet KED testing as well as provide superior flight characteristics for the toy foam dart 10. Further, the configuration of the hollow passage 32 that forms first and second mouth openings 33.1, 33.2 along with the eye socket indents 36.1, 36.2; 38.1, 38.2 on the respective sides of the dart tip 20 make the dart 10 more interesting and provide additional play value for, in particular, juvenile users.

While the dart tip 20 is preferably made of injection molded thermoplastic rubber including the weighting material, it is also possible to form the dart tip 20 from other materials via other processes.

In the first embodiment of the toy foam dart 10, the hollow passage 32 has a greater opening dimension for the passage height h2 at the edges 34.1, 34.2 of the hollow passage 32 in comparison to an opening dimension for the passage height h1 at the medial portion. This specific arrangement provides for more uniform impact absorption around the periphery of the dart tip 20 given the greater material removal away from the medial area toward the edges 34.1, 34.2. Preferably, the opening dimension for the passage height h2 at the edges 34*a*, 34*b* is at least two times the opening dimension for the passage height h1 at the medial portion.

Additionally, a width W of the hollow passage 32 in the second direction Z is preferably at least 60% of the diameter D of the dart tip 20. More preferably, the width W is between 70 and 85% of the diameter D of the dart tip 20.

FIGS. 4-11 show alternate embodiments of the dart tip 20*a*-20*h*. These alternate embodiments of the dart tip 20*a*-20*h* are similar to the first embodiment 20; however, the configuration of the hollow passage 32 can be varied as described below in addition to the shapes of the first and second pairs of eye sockets indents 36*a, b*; 38*a, b*. By varying the shape of the hollow passage 32*a*-32*h* as well as the first and second pairs of eye sockets indents 36.1*a* and 36.1 to h, 36.2*a* and 36.2*c-h* as well as the identical eye socket indents on the opposing side of the dart tip corresponding to 38.1, 38.2, different energy absorbing properties can be achieved along with different looks for the face configuration that is formed on opposing sides of the dart tip 20.

For the embodiments of the dart tip 20*a*, 20*b*, 20*g*, 20*h*, as shown in FIGS. 4, 5, 10, and 11, the hollow passage 32*a*, 32*b*, 32*g*, and 32*h* has a smaller opening dimension for the passage height h2 at the edges 34.1, 34.2 in comparison to an opening dimension for the passage height h1 at a medial portion. This provides a different energy absorbing profile for the hollow passage 32*a, b, g*, and *h* in comparison to the hollow passage 32. Different looks are also provided for the first and second mouth openings 33.1*a, b, g*, and *h* (it being understood that the second mouth openings on the opposite side of the dart tip that are not shown are identically shaped).

Figure 4:
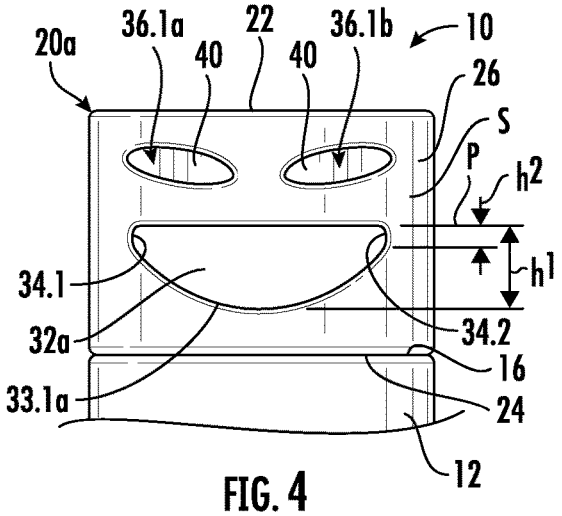
FIG. 4 is an enlarged front elevational view showing the dart tip and part of the elongate dart body of a second embodiment of a toy foam dart in accordance with the disclosure.
Figure 9:
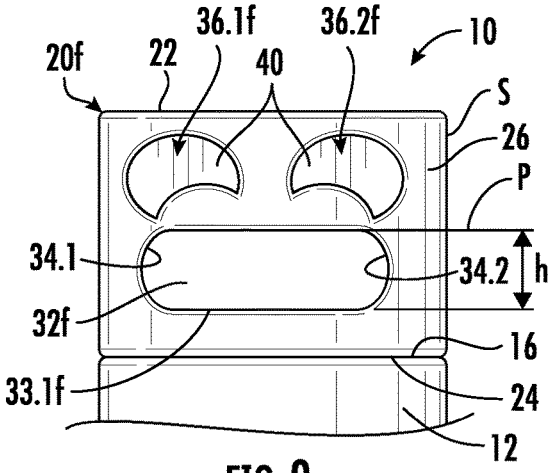
FIG. 9 is an enlarged front elevational view showing the dart tip and part of the elongate dart body of a seventh embodiment of a toy foam dart in accordance with the disclosure.
Figure 10:
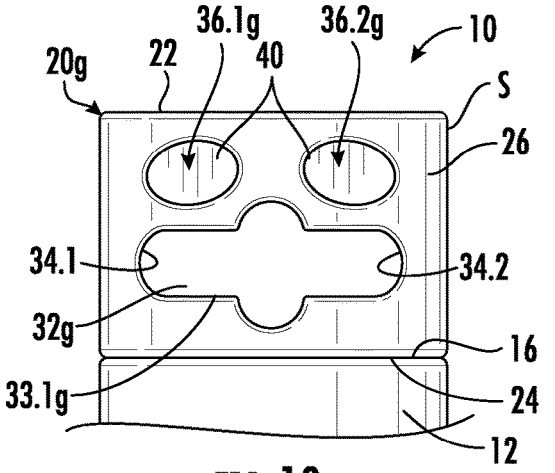
FIG. 10 is an enlarged front elevational view showing the dart tip and part of the elongate dart body of an eighth embodiment of a toy foam dart in accordance with the disclosure.
Figure 11:
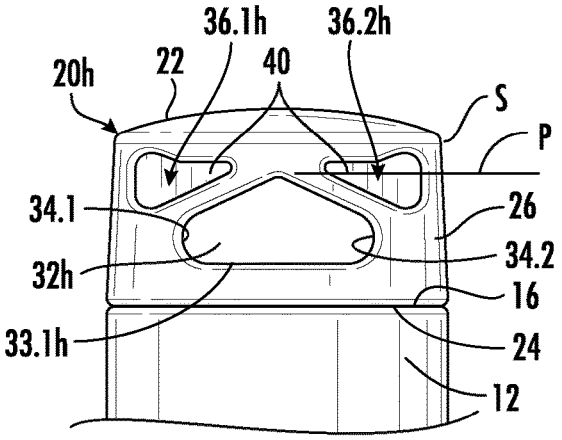
FIG. 11 is an enlarged front elevational view showing the dart tip and part of the elongate dart body of a ninth embodiment of a toy foam dart in accordance with the disclosure.
Figure 12:
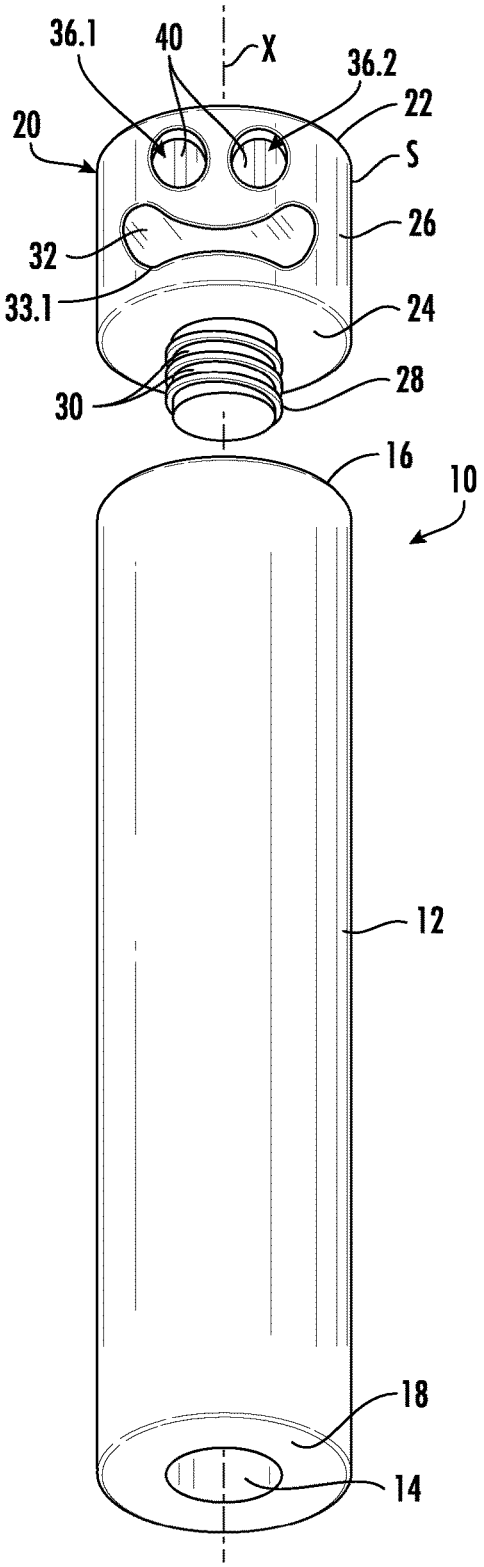
FIG. 12 is an exploded view showing the assembly of the toy foam dart of FIGS. 1-3.

Referring to FIGS. 4 and 9 in connection with the dart tip 20*a* and 20*f*, here, the hollow passage 32*a*, 32*f* has a planar upper surface P closer to the top 22 of the dart tip 20. Again, this provides for a different look for the face configuration provided on opposing sides of the dart tip 20 by the first and second mouth openings 33.1*a*, 33.1*f* (with the oppositely located second mouth openings being identical) as well as different energy absorbing properties for the dart tip 20*a*, 20*f*.

Figure 5:
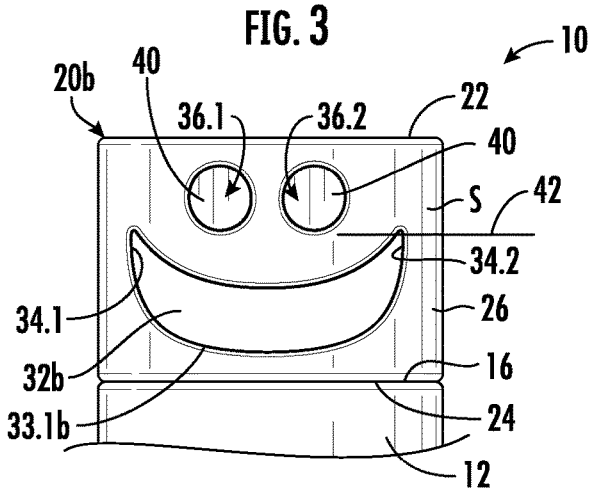
FIG. 5 is an enlarged front elevational view showing the dart tip and part of the elongate dart body of a third embodiment of a toy foam dart in accordance with the disclosure.
Figure 6:
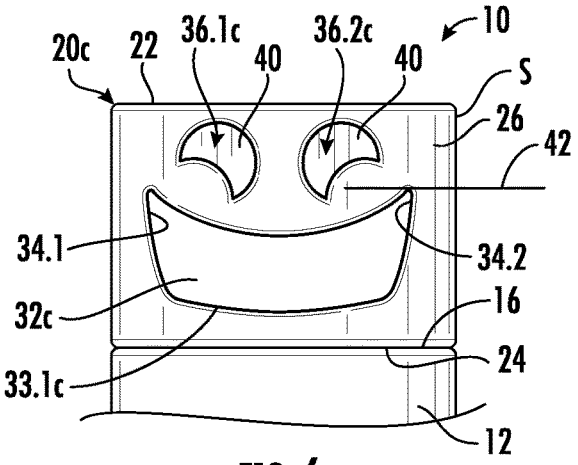
FIG. 6 is an enlarged front elevational view showing the dart tip and part of the elongate dart body of a fourth embodiment of a toy foam dart in accordance with the disclosure.

In order to form a smiling face configuration, as shown in FIGS. 5 and 6 in connection with dart tips 20*b* and 20*c*, the hollow passage 32*b*, 32*c* can have a smaller opening dimension for the passage height h2 at the edges 34.1, 34.2 in comparison to an opening dimension of the passage height h1 at the medial portion, and the edges 34.1. 34.2 are located closer to the top 20 of the dart tip than the medial portion of the hollow passage way 32. Here, it is possible for the edges 34.1, 34.2 to be located in a plane 42 perpendicular to the longitudinal direction X that intersects a lower portion of the first and second pairs of eye socket indents 36.1*b* and *c*, 36.2 *b* and *c* (with the oppositely located second pair of eye socket indents being identical). This provides for different looks for the face configuration as well as different force absorbing properties based on this additional upper cut toward the top of the dart tip 20 closer to the edges 34.1, 34.2 of the hollow passage 32*b*, 32*c*.

Figure 7:
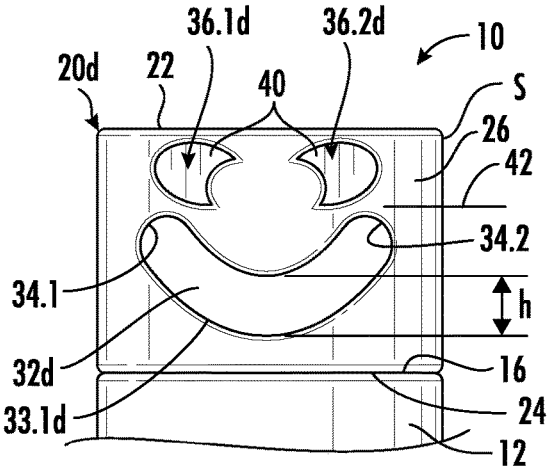
FIG. 7 is an enlarged front elevational view showing the dart tip and part of the elongate dart body of a fifth embodiment of a toy foam dart in accordance with the disclosure.
Figure 8:
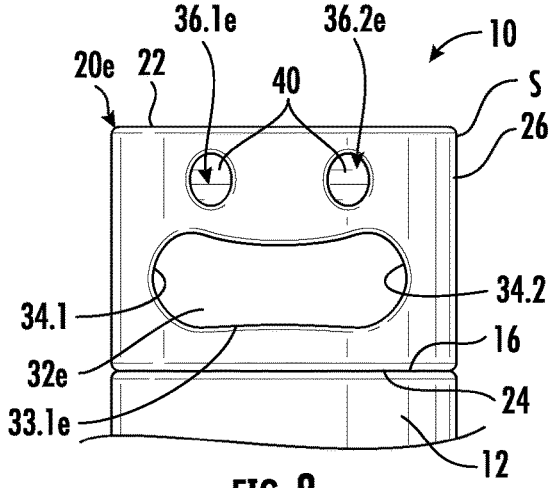
FIG. 8 is an enlarged front elevational view showing the dart tip and part of the elongate dart body of a sixth embodiment of a toy foam dart in accordance with the disclosure.

Referring to FIGS. 7 and 9, in connection with the embodiments of the dart tip 20*d* and 20*f*, the hollow passage 32*d*, 32*f* can have a generally uniform opening dimension h for the passage height. As shown in connection with the dart tip 20*d* shown in FIG. 7, it is further possible for the edges 34.1, 34.2 to be located closer to the top 22 of the dart tip 20 than a medial portion of the hollow passage 32*d* such that the hollow passage 32*d* has a curved profile at the first and second mouth openings 33.1 (with the oppositely located second mouth opening being identical). In both cases, different looks for the face configuration on the opposing sides of the dart tip 20*d*, 20*f* are created along with different energy absorbing properties.

In connection with FIGS. 4-11, and the embodiments of the dart tip 20*a*-20*h* shown, first pairs of eye socket indents 36.1*a* and 36.1*c-h*, 36.2*a* and 36.2*c-h* having different configurations are shown (with the oppositely located second pair of eye socket indents being identical). Similar to the first embodiment of the dart tip 20, the third embodiment of the dart tip 20*b* also includes first and second pairs of eye socket indents 36.1, 36.2; 38.1, 38.2 having a circular configuration.

As shown in FIGS. 4 and 6-11, the first and second pairs of eye socket indents 36.1*a* and 36.1*c-h*, 36.2*a* and 36.2*c-h* may have a non-circular configuration, with the eye socket indents in the first pair of eye sockets indents 36.1*a* and 36.1*c-h*, 36.2*a* and 36.2*c-h* being mirror-symmetric to one another about a longitudinal plane defined by the longitudinal direction X and the first direction Y, and the eye socket indents of the second pair of eye socket indents would also be mirror-symmetric to one another about the longitudinal plane so defined (as the oppositely located second pair of eye socket indents are identical to the first pair of eye socket indents in each of the illustrated embodiments). These various shapes for the eye socket indents not only provide for different looks for the face configuration on opposing sides of the dart tip 20, but also allow for different weight control in connection with the overall weight of the dart tip 20 by providing different volumes of material that are removed from the cylindrical envelope S defined by an outer periphery of the dart tip 20.

For enhanced play value, the disclosure also provides for a toy that includes first and second sets of the toy foam darts 10 having different tips 20, 20*a*-20*h* as described above. These first and second sets of toy foam darts 10 with tips 20, 20*a*-20*h* each include a plurality of the foam darts 10 and at least one of the first and second mouth openings or the first and second pairs of eye socket indents in the first set of toy foam darts 10 are different than respectively, at least one of the first and second mouth openings or the first and second pairs of eye socket indents in the second set of toy foam darts 10. This allows users to more easily sort their darts 10 based on the different face configuration. This also allows for selecting custom sets of toy foam darts 10 that are suited to a particular user. Further, having differentiated toy foam darts 10 allows for users to have enhanced play by creating different scenarios or games that involve the thus differentiated toy foam darts 10 having dart tips 20, 20*a*-20*h* with different face configurations.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A toy form dart, comprising:

an elongate dart body having an interior bore that extends in a longitudinal direction from a head end to a tail end of the elongate dart body;

a dart tip connected to the head end of the elongate dart body, the dart tip having a top, a bottom that is affixed into the interior bore at the head end of the elongate dart body, and an outer surface extending from the top to the bottom of the dart tip in the longitudinal direction;

a hollow passage extends through the dart tip in a first direction perpendicular to the longitudinal direction defining first and second mouth openings on opposing sides of the dart tip, the hollow passage having an aspect ratio of at least 1:1 of a passage width in a second direction that is perpendicular to the first direction and the longitudinal direction in comparison to a passage height in the longitudinal direction, edges of the hollow passage define the width in the first direction;

first and second pairs of eye socket indents located between the respective first and second mouth openings and the top of the dart tip, the first and second eye socket indents penetrating only partially into the dart tip and an interior boundary wall formed between each one of the first pair of eye socket indents and each respective oppositely located one of the second pair of eye socket indents;

wherein the first and second pairs of eye socket indents and the respective first and second mouth openings form a face configuration on the opposing sides of the dart tip.

2. The toy form dart of claim 1, wherein the hollow passage has a greater opening dimension for the passage height at the edges in comparison to an opening dimension for the passage height at a medial portion.

3. The toy form dart of claim 2, wherein the opening dimension for the passage height at the edges is at least two times the opening dimension for the passage height at the medial portion.

4. The toy form dart of claim 1, wherein the hollow passage has a smaller opening dimension for the passage height at the edges in comparison to an opening dimension for the passage height at a medial portion.

5. The toy form dart of claim 4, wherein the hollow passage has a planar upper surface closer to the top of the dart tip.

6. The toy form dart of claim 1, wherein the hollow passage has a smaller opening dimension for the passage height at the edges in comparison to an opening dimension of the passage height at a medial portion, and the edges are located closer to the top of the dart tip than the medial portion of the hollow passage.

7. The toy foam dart of claim 6, wherein the edges are located in a plane perpendicular to the longitudinal direction that intersects a lower portion of the first and second pairs of eye socket indents.

8. The toy form dart of claim 1, wherein the hollow passage has a generally uniform opening dimension for the passage height, and the edges are located closer to the top of the dart tip than a medial portion of the hollow passage such that the hollow passage has a curved profile at the first and second mouth openings.

9. The toy form dart of claim 1, wherein the eye socket indents of each of the first and second pairs of eye socket indents have a circular configuration.

10. The toy form dart of claim 1, wherein the eye socket indents of each of the first and second pairs of eye socket indents have a non-circular configuration, with the eye socket indents in the first pair of eye socket indents being mirror-symmetric to one another about a longitudinal plane defined by the longitudinal direction and the first direction, and the eye socket indents in the second pair of eye socket indents being mirror-symmetric to one another about the longitudinal plane.

11. The toy form dart of claim 1, wherein the dart tip is molded from a polymeric material mixed with powdered weighting agent.

12. The toy form dart of claim 11, wherein the powdered weighting agent is calcium carbonate powder.

13. The toy form dart of claim 11, wherein the powdered weighting agent is between 10 and 20 wt % of the dart tip.

14. The toy form dart of claim 11, wherein the dart tip weight is 0.61 to 0.88 grams.

15. The toy form dart of claim 11, wherein the aspect ratio of at least 2:1.

16. A toy comprising first and second sets of toy foam darts, the first and second sets of toy foam darts each including a plurality of the foam darts according to claim 1, wherein at least one of the first and second mouth openings or the first and second pairs of eye socket indents in the first set of toy foam darts are different than respectively at least one of the first and second mouth openings or the first and second pairs of eye socket indents in the second set of toy foam darts.

* * * * *